US007693470B2

(12) United States Patent
Mori

(10) Patent No.: US 7,693,470 B2
(45) Date of Patent: Apr. 6, 2010

(54) IMAGE FORMING APPARATUS WITH A BELT FOR CONVEYING SHEETS

(75) Inventor: Hirotaka Mori, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 131 days.

(21) Appl. No.: 11/860,764

(22) Filed: Sep. 25, 2007

(65) Prior Publication Data

US 2008/0267657 A1 Oct. 30, 2008

(30) Foreign Application Priority Data

Apr. 27, 2007 (JP) ..... 2007-118310

(51) Int. Cl.
*G03G 15/16* (2006.01)

(52) U.S. Cl. ..... 399/303; 399/101; 399/313

(58) Field of Classification Search ..... 399/303, 399/313, 66, 101
See application file for complete search history.

(56) References Cited

U.S. PATENT DOCUMENTS 5,970,278 A * 10/1999 Munakata ..... 399/101 X
7,366,438 B2 * 4/2008 Takeuchi et al. ..... 399/101
2001/0018000 A1 * 8/2001 Hirai ..... 399/313 X
2004/0208678 A1 * 10/2004 Yoda et al. ..... 399/313 X
2006/0210300 A1 * 9/2006 Nishikawa ..... 399/101
2007/0029717 A1 2/2007 Mori
2007/0230994 A1 * 10/2007 Takishita ..... 399/101

FOREIGN PATENT DOCUMENTS

JP 11-352796 A * 12/1999
JP 2003-057965 A * 2/2003
JP 2007-010976 1/2007

* cited by examiner

*Primary Examiner*—Sophia S Chen
(74) *Attorney, Agent, or Firm*—Banner & Witcoff, Ltd

(57) ABSTRACT

An image forming apparatus includes: a plurality of rollers including a drive roller and a follow roller; an endless belt made of an insulation material and looped around the plurality of rollers so that a bridging portion is formed between adjacent rollers and both ends of the bridging portion are supported on the adjacent rollers; a photosensitive drum positioned outside of and facing the outer peripheral surface of the bridging portion; and a transfer roller positioned opposite of the photosensitive drum with the bridging portion interposed therebetween. The inner peripheral surface of the belt is made of a material which has greater tendency to be charged in a polarity that is the same as developer in triboelectric series than the outer peripheral surface of the follow roller as an upstream-side roller.

16 Claims, 5 Drawing Sheets

FIG. 3

TRIBOELECTRIC SERIES

| | |
|---|---|
| PLUS (+) (MOST POSITIVE) ↑ | ASBESTOS |
| | GLASS |
| | MICA |
| | NYLON |
| | LEAD |
| | SILK |
| | ALUMINUM |
| | PAPER |
| | STEEL |
| | COTTON |
| | RUBBER |
| | NICKEL, COPPER |
| | BRASS, SILVER |
| | SULFUR |
| | RAYON |
| ↓ MINUS (−) (MOST NEGATIVE) | POLYESTER |
| | URETHANE |
| | POLYETHYLENE |
| | VINYL |
| | TEFLON |

IMAGE FORMING APPARATUS WITH A BELT FOR CONVEYING SHEETS

CROSS REFERENCE TO RELATED APPLICATIONS

This application claims the foreign priority benefit under Title 35, United States Code, §119(a)-(d) of Japanese Patent Application No. 2007-118310 filed on Apr. 27, 2007 in the Japan Patent Office, the disclosure of which is herein incorporated by reference in its entirety.

BACKGROUND OF THE INVENTION

The present invention relates to an image forming apparatus equipped with a belt for conveying record sheets, and a photosensitive element and a transfer element which are arranged opposite to each other with the belt interposed therebetween.

A conventional electrophotographic image forming apparatus is known, for example, from Japanese Laid-open Patent Application No. 2007-10976. In this type of image forming apparatus, developer is transferred on a record sheet during the conveyance of the record sheet on an endless belt. To be more specific, the belt of this conventional image forming apparatus is looped around a plurality of rollers, and a bridging portion, i.e., a portion whose ends are supported on adjacent rollers with a tension applied to the belt, lies interposed between a photosensitive element and a transfer element. Since the photosensitive element carries developer that is charged in a predetermined polarity and the transfer element is applied with a transfer bias having a polarity that is opposite to the developer, the developer is drawn or transferred from the photosensitive element to the transfer element. When the transfer bias is applied to the transfer element, the inner peripheral surface of the belt is charged in the polarity that is opposite to the transfer bias because of the effect of the transfer bias, whereas the outer peripheral surface of the belt is charged in the same polarity as the transfer bias. Accordingly, the developer is transferred from the photosensitive element toward the belt so that images are formed on a record sheet by the developer.

The object of the present invention is to provide an image forming apparatus which further improves image quality of transferred images on a record sheet.

As a result of intensive search to attain the objective mentioned above, the inventor of the present invention has found that image quality of transferred images can be improved further if the outer peripheral surface of the belt is charged in the polarity that is opposite to the developer before a record sheet reaches the transfer position.

SUMMARY OF THE INVENTION

According to one aspect of the present invention, there is provided an image forming apparatus which comprises: a plurality of rollers; an endless belt looped around the plurality of rollers so that a bridging portion is formed between adjacent rollers and both ends of the bridging portion are supported on the adjacent rollers, the endless belt being insulative and driven in a predetermined driving direction so as to convey a record sheet; a photosensitive element positioned outside of and facing the outer peripheral surface of the bridging portion of the endless belt, the photosensitive element forming developer images when electrostatically charged developer is deposited thereon; and a transfer element positioned opposite of the photosensitive element with the bridging portion interposed therebetween, and to which a transfer bias is applied so as to transfer the developer from the photosensitive element. The plurality of rollers includes an upstream-side roller for supporting an upstream end of the bridging portion that is interposed between the photosensitive element and the transfer element as seen in the driving direction of the endless belt. Further, the inner peripheral surface of the endless belt is made of a material which has greater tendency to be charged in a polarity that is the same as the developer in triboelectric series than the outer peripheral surface of the upstream-side roller.

According to another aspect of the present invention, there is provided an image forming apparatus which comprises: a plurality of rollers; an endless belt looped around the plurality of rollers so that a bridging portion is formed between adjacent rollers and both ends of the bridging portion are supported on the adjacent rollers, the endless belt being insulative and driven in a predetermined driving direction so as to convey a record sheet; a photosensitive element positioned outside of and facing the outer peripheral surface of the bridging portion of the endless belt; a charger for charging a surface of the photosensitive element; an exposure device for exposing the surface of the photosensitive element to be charged by the charger; and a transfer element positioned opposite of the photosensitive element with the bridging portion interposed therebetween, and to which a transfer bias is applied so as to transfer developer that is deposited on the exposed surface of the photosensitive element from the photosensitive element. The plurality of rollers includes an upstream-side roller for supporting an upstream end of the bridging portion that is interposed between the photosensitive element and the transfer element as seen in the driving direction of the endless belt. Further, the inner peripheral surface of the endless belt is made of a material which has greater tendency to be charged in a polarity that is the same as the photosensitive element to be charged by the charger in triboelectric series than the outer peripheral surface of the upstream-side roller.

In the case where the endless belt is made of an insulation material, the charge distribution of the endless belt becomes stable at the transfer position where the endless belt lies interposed between the photosensitive element and the transfer element, i.e. a change in the charge distribution is properly restricted. This enables developer to be well transferred toward the endless belt, so that image quality of transferred images can be improved.

However, the charge distribution of this insulative belt may change to a different charge distribution that is riot suitable for transfer of images due to frictional contact between the endless belt and the rollers. Once the charge distribution is changed, this change is also maintained at the transfer position, which results in a possibility that the image quality of the transferred images disadvantageously deteriorates.

According to the present invention, the inner peripheral surface of the endless belt is either made of a material which has greater tendency to be charged in a polarity that is the same as the developer in triboelectric series than the outer peripheral surface of the upstream-side roller, or a material which has greater tendency to be charged in a polarity that is the same as the photosensitive element to be charged by the charger in triboelectric series than the outer peripheral surface of the upstream-side roller. In other words, the inner peripheral surface of the endless belt is either made of a material positioned in triboelectric series so that the material has greater tendency to be charged in a polarity that is the same as a charge polarity of the developer than the outer peripheral surface of the upstream-side roller, or a material positioned in triboelectric series so that the material has greater tendency to be charged in a polarity that is the same as a charge polarity of the photosensitive element to be charged by the charger than the outer peripheral surface of the upstream-side roller. Therefore, the inner peripheral surface of the endless belt is charged in a polarity that is the same as the developer or the photosensitive element by the frictional contact with the outer peripheral surface of the upstream-side roller. Once the endless belt frictionally contacts with the upstream-side roller, the outer peripheral surface of the endless belt is charged in a polarity that is opposite to the developer or the photosensitive element. The charge distribution of the endless belt is maintained thereafter because the endless belt is made of an insulation material. The outer peripheral surface of the endless belt reliably charges in the opposite polarity of the developer or the photosensitive element at the transfer position where the endless belt lies interposed between the photosensitive element and the transfer element. This enables developer to be well transferred toward the endless belt, and the image quality of the transferred images can be improved further.

Other features and advantages of the present invention will be apparent from the following description taken in conjunction with the accompanying drawings.

BRIEF DESCRIPTION OF THE DRAWINGS

Other objects and aspects of the present invention will become more apparent by describing in detail illustrative, non-limiting embodiments thereof with reference to the accompanying drawings, in which:

FIG. 3 is a table explaining triboelectric series;

DETAILED DESCRIPTION OF THE INVENTION

One preferred embodiment of the present invention will be described in detail with reference to FIG. 1.

Figure 1:
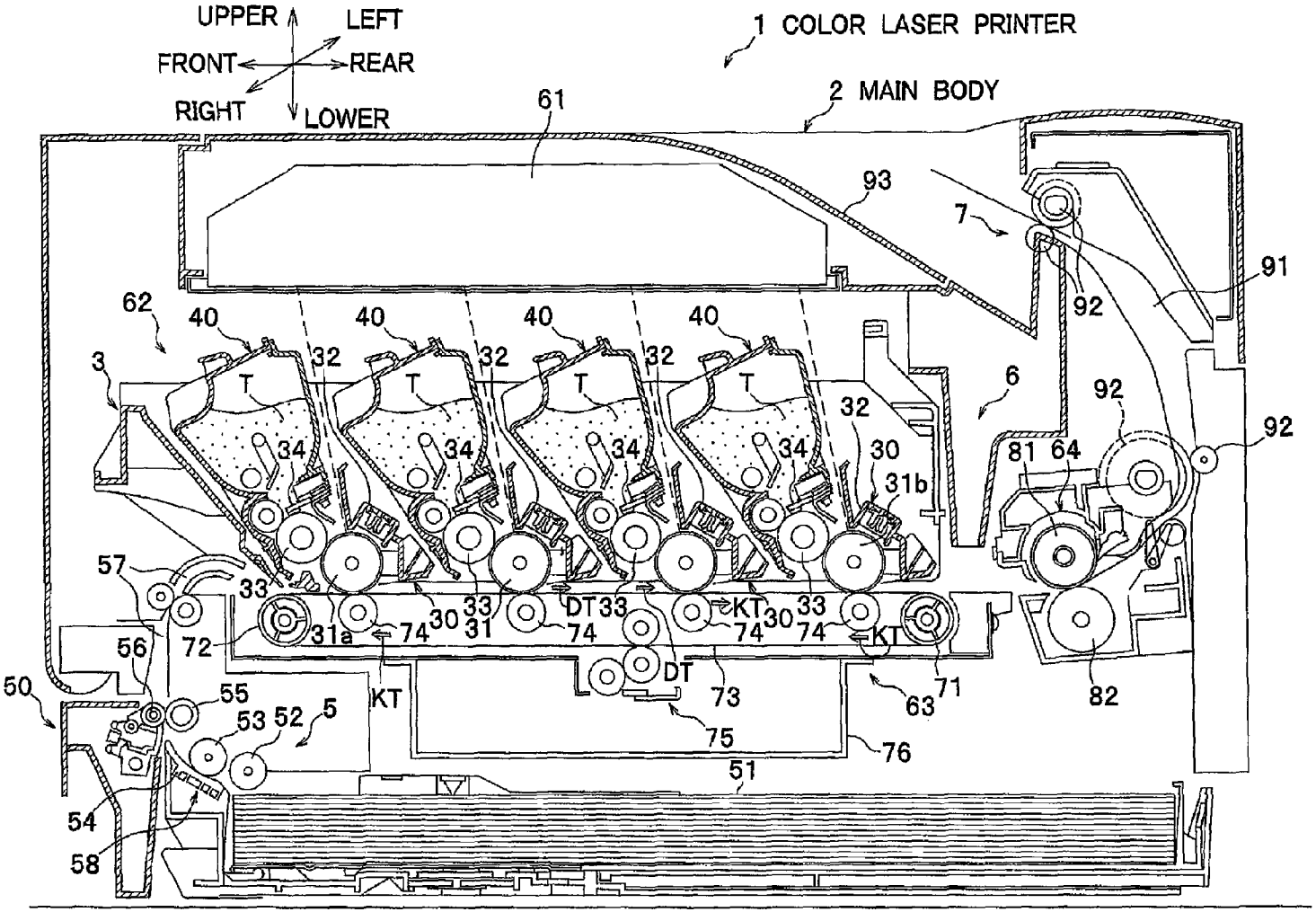
FIG. 1 is a sectional view illustrating the overall structure and main parts of a color laser printer as one embodiment of the image forming apparatus according to the present invention.

FIG. 1 is a sectional view illustrating the overall structure and main parts of a color laser printer as one embodiment of the image forming apparatus according to the present invention. In the following description, at first, the overall structure of the color laser printer will be described, and then detailed description will be given on the characterizing feature of the present invention.

Overall Structure of Color Laser Printer 1

As seen in FIG. 1, a color laser printer 1 includes a main body 2, a paper feeding unit 5 for feeding papers 51 as one example of record sheets one at a time, an image forming unit 6 for forming images on a paper 51 to be fed from the paper feeding unit 5, and a paper discharging unit 7 for discharging papers 51 onto which images have been formed.

In the following description, unless otherwise stated, an upper and lower direction in FIG. 1 will be referred to as a "vertical direction", a left and right direction in FIG. 1 as a "front-rear direction", a direction toward the viewer of FIG. 1 as a "right direction", and a direction away from the viewer of FIG. 1 as a "left direction." Also, directions such as "front or near side", "rear or far side", "upper", "lower", "right", and "left" are used to define the various parts on the basis of the direction in which the viewer stands in front of the color laser printer 1 and looks at the same.

(1) Paper Feeding Unit 5

The paper feeding unit 5 includes a paper feed tray 50 attached to and detachable from the main body 2, a paper feeding mechanism 58 for feeding papers 51 one at a time from the paper feed tray 50 to the image forming unit 6.

The paper feeding mechanism 58 mainly consists of a feed roller 52, a separation roller 53, and a separation pad 54, which are provided in the front end side of the paper feed tray 50 to feed papers 51 one at a time in the upper direction to the subsequent unit. The paper 51 is conveyed in the upper direction and passes between a cleaning roller 55 and a pinch roller 56, during which paper dust is removed. The paper 51 then passes through a conveyance passage 57, so that the feeding direction of the paper 51 is changed from the near side to the far side and the paper 51 is received on a belt 73.

(2) Image Forming Unit 6

The image forming unit 6 includes a scanner unit 61 as one example of an exposure device, a processing unit 62, a transfer unit 63, and a fixing unit 64.

Scanner Unit 61

The scanner unit 61 is provided at an upper part of the main body 2. Although not shown in the figures, the scanner unit 61 includes a laser light-emitting device, a polygon mirror, a plurality of lenses, and plurality of reflecting mirrors. In the scanner unit 61, a laser light is emitted from the laser light-emitting device in accordance with colors including cyan, magenta, yellow, and black. The polygon mirror scans the laser light at high speeds in the right and left directions. The laser light then passes through the plurality of lenses and is reflected at the reflecting mirrors, and thereafter it is irradiated onto the corresponding photosensitive drum 31.

Processing Unit 62

The processing unit 62 is arranged between the scanner unit 61 and the transfer unit 63. The processing unit 62 includes a photosensitive unit 3, and developer cartridges 40 to be attached to the photosensitive unit 3.

The photosensitive unit 3 is attached to and detachable from the main body 2. The photosensitive unit 3 includes four drum subunits 30 corresponding to cyan, magenta, yellow, and black, which are arranged in line along the horizontal direction. Attached to each drum subunit 30 is a developer cartridge 40 containing toner T as one example of developer for the corresponding color.

Each drum subunit 30 is equipped with a photosensitive drum 31, a Scorotron charger 32, etc. The developer cartridge 40 includes a developing roller 33 for feeding toner T onto the photosensitive drum 31, a doctor blade 34 for restricting the thickness of the toner deposited on the developing roller 33, etc. Toner T charges positively (plus polarity) when it makes a frictional contact between the developing roller 33 and the doctor blade 34. In other words, toner T normally charges positively according to this embodiment.

In this processing unit 62, the surface of the photosensitive drum 31 is charged positively (plus polarity) by the Scorotron charger 32. When this charged area of the photosensitive drum 31 is exposed to the laser light that is irradiated from the scanner unit 61, the electric potential of this area lowers so that a latent image associated with image data is formed on the photosensitive drum 31. Further, when the latent image is applied with plus-charged toner T that has been charged positively between the developing roller 33 and the doctor blade 34, a toner image is formed on the photosensitive drum 31.

Transfer Unit 63

The transfer unit 63 includes a drive roller 71, a follow roller 72, a belt 73, a transfer roller 74, and a cleaning device 75. General structure of the transfer unit 63 will be described below, and the characterizing feature of the present invention will be described later in detail.

The drive roller 71 and the follow roller 72 are arranged parallel and separately to each other, and the belt (endless belt) 73 is looped around the drive roller 71 and the follow roller 72. The driver roller 71 and the follow roller 72 are adjacent to each other in the bridging direction of the belt 73.

As seen in FIG. 1, when the drive roller 71 is driven to rotate, the belt 73 is driven and turns together with the follow roller 72 so as to convey a record sheet in a conveying direction DT in which the record sheet is conveyed from the front side (near side) to the rear side (far side) of the color laser printer 1. Reference character KT shown in FIG. 1 denotes the driving direction KT of the belt.

Transfer rollers 74 are arranged inside the belt 73. Each transfer roller 74 is positioned opposite of the corresponding photosensitive drum 31 with the belt 73 interposed therebetween. A high voltage circuit board (not shown) applies a transfer bias having a minus polarity to the transfer roller 74. Upon image formation, the belt 73 conveys a paper 51 to the position where the belt 73 is interposed between the photosensitive drum 31 and the transfer roller 74 so that a toner image formed on the photosensitive drum 31 is transferred on the paper 51.

It is noted that the photosensitive drum 31 that is positioned on the upstream-most side as seen in the conveying direction DT of the belt 73 is herein denoted by the reference numeral 31*a*, and the photosensitive drum 31 that is positioned on the downstream-most side as seen in the conveying direction DT of the belt 73 is herein denoted by the reference numeral 31*b*. The follow roller that is positioned just in front of, namely, further upstream of the photosensitive drum 31*a* corresponds to one example of an upstream-side roller.

The cleaning device 75 is positioned below the belt 73. The cleaning device 75 removes toner T that is adhered on the belt 73 so that the removed toner T is received and stored in a toner storage tank 76.

Fixing Unit 64

The fixing unit 64 is positioned downstream of the transfer unit 63 as seen in the conveying direction DT. In other words, the fixing unit 64 is positioned in the rear side of the main body 2. The fixing unit 64 is equipped with a heating roller 81 and a pressure roller 82.

A halogen lamp is provided in the heating roller 81 so as to heat the surface of the heating roller 81 to a fixing temperature. The pressure roller 82 is positioned such as to contact with the heating roller 81 with a predetermined pressure. Toner image formed on a paper 51 is heat fixed while the paper 51 is being fed between the heating roller 81 and the pressure roller 82.

(3) Paper Output Unit 7

In the paper output unit 7, a paper output-side conveyance passage 91 for outputting papers 51 extends upward from the outlet of the fixing unit 64 and changes the paper outputting direction reversely from the far side to the near side. A plurality of conveyance rollers 92 for conveying papers 51 are arranged along the paper output-side conveyance passage 91. Provided on the top surface of the main body 2 is a paper output tray 93 having an appropriate recess for receiving printed papers 51. The printed paper 51 are conveyed through the paper output-side conveyance passage 91 one at a time by the conveyance rollers 92, and they are output from the paper output-side conveyance passage 91 and stacked on the paper output tray 93.

Structure of the transfer unit 63, which is the characterizing feature of the present invention, will be described in detail with reference to FIG. 2.

Figure 2:
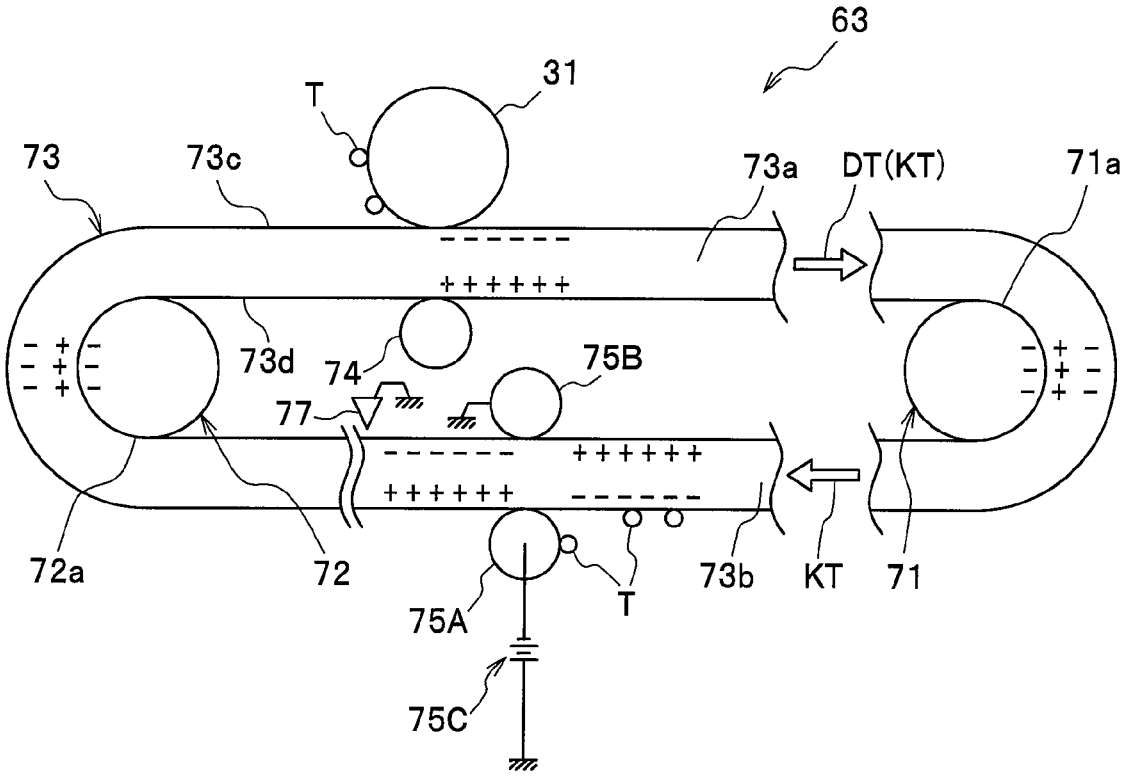
FIG. 2 is a view explaining the charge distribution of parts in the transfer unit.

As shown in FIG. 2, the belt 73 is looped around the drive roller 71 and the follow roller 72 in the transfer unit 63 so that a bridging portion is formed between these adjacent rollers 71, 72 and both ends of the bridging portion are supported on the adjacent rollers 71, 72 with a tension applied to the belt 73. That portion which is bridging in the substantially horizontal direction at the upper part of the belt 73 between the drive roller 71 and the follow roller 72 is referred to as an upper bridging portion 73*a*, whereas that portion which is bridging in the substantially horizontal direction at the lower part of the belt 73 is referred to as a lower bridging portion 73*b*. To be more specific, the upstream end of the bridging portion 73*a* as seen in the driving direction KT of the belt 73 is supported on the follow roller 72, and the downstream end of the bridging portion 73*a* as seen in the driving direction KT of the belt 73 is supported on the drive roller 71.

The photosensitive drum 31 is positioned outside of and facing the outer peripheral surface 73*c* of the upper bridging portion 73*a*, and the transfer roller 74 is positioned opposite of the photosensitive drum 31 with the upper bridging portion 73*a* interposed therebetween. Further, a cleaning roller 75A is positioned outside of and facing the outer peripheral surface 73*c* of the lower bridging portion 73*b*, and a backup roller 75B is positioned opposite of the cleaning roller 75A with the lower bridging portion 73*b* interposed therebetween.

The drive roller 71, the follow roller 72, and the belt 73 are made of materials to be selected on the basis of triboelectric series. More specifically, the belt 73 is made of a material which has greater tendency to be charged in a polarity that is on the side of the normally charged toner T (plus in this preferred embodiment) than the drive roller 71 and the follow roller 72. In other words, the belt 73 is made of a material positioned in triboelectric series so that the material has greater tendency to be charged in a polarity (plus) that is the same as a charge polarity of the toner T than the drive roller 71 and the follow roller 72. Namely, the belt 73 is made of a material that is closer to the positive end in the triboelectric series as with the plus-charged toner T than the drive roller 71 and the follow roller 72.

Herein, the "triboelectric series" is a list of materials, showing which have a greater tendency to become positive (plus) and which have a greater tendency to become negative (minus), when two different materials are rubbed together. Materials which are more apt to charge in the plus polarity are arranged on the side of plus, and materials which are more apt to chare in the minus polarity are arranged on the side of minus.

FIG. 3 shows a triboelectric series. For example, as shown in FIG. 3, nylon is closer to the positive end in the triboelectric series than rayon, so that when nylon and rayon are rubbed together, nylon charges positively and rayon charges negatively.

As with this preferred embodiment, the belt 73 is preferably made of a material mainly containing nylon, which is suitable for use with plus-charged toner T. The term "material mainly containing nylon" indicates a material merely consisting of nylon as well as a material containing nylon and other materials, in which the total amount of mass of nylon is larger than that of each of the other materials.

In the case where the belt 73 is made of a material mainly containing nylon, it is preferable that the outer peripheral surface 71*a* of the drive roller 71 is made of urethane and the outer peripheral surface 72*a* of the follow roller 72 is made of aluminum.

The drive roller 71, the follow roller 72, and the belt 73 are made of materials as described above. Therefore, the inner peripheral surface 73*d* of the belt 73 is charged in the same polarity (plus) as the plus-charged toner T by the frictional contact with the outer peripheral surface 71*a* of the drive roller 71. The frictional contact with the outer peripheral surface 72*a* of the follow roller 72 also makes the inner peripheral surface 73*d* of the belt 73 charge in the same polarity (plus) as the plus-charged toner T. The drive roller 71 is made of a material having a higher friction coefficient than the follow roller 72 so as to reliably and properly turn the belt 73.

In order to check whether the belt 73 is made of a material which has greater tendency to be charged in the same polarity as the toner T in the triboelectric series than the drive roller 71, an electrostatic voltmeter may be used to measure the surface potential on the outer peripheral surface 71*a* of the drive roller 71 and the inner peripheral surface 73*d* of the belt 73, respectively, after the frictional contact between the outer peripheral surface 71*a* of the drive roller 71 and the inner peripheral surface 73*d* of the belt 73.

In the case where the surface potential on the inner peripheral surface 73*d* of the belt 73 takes a positive value, it is confirmed that the inner peripheral surface 73*d* of the belt 73 has charged positively. Further, in the case where the surface potential on the outer peripheral surface 71*a* of the drive roller 71 takes a negative value, it is confirmed that the outer peripheral surface 71*a* of the drive roller 71 has charged negatively. The electrostatic voltmeter can also be used to check whether the belt 73 is made of a material which has greater tendency to be charged in the same polarity as the toner T in the triboelectric series than the follow roller 72.

In this preferred embodiment, the belt 73 is made of a material mainly containing nylon, the surface layer (outer peripheral surface 71*a*) of the drive roller 71 is made of urethane, and the surface layer (outer peripheral surface 72*a*) of the follow roller 72 is made of aluminum. Accordingly, the inner peripheral surface 73*d* of the belt 73 charges positively when it frictionally contacts with the drive roller 71 and the follow roller 72, respectively. The belt 73 is made of an insulation material.

The term "insulation material" generally includes a material having a volume resistance of $10^{11}$ [Ω·cm] and more. Since the belt 73 is made of a material whose volume resistance is equal to or more than $10^{11}$ [Ω·cm], the charge distribution of the belt 73 becomes reasonably stable so that a toner image can be well transferred on a paper 51.

Preferably, the belt 73 is made of a material whose volume resistance is in the range of $10^{11}$-$10^{16}$ [Ω·cm]. Since the belt 73 is made of a material whose volume resistance is equal to or lower than $10^{16}$ [Ω·cm], the discharge of the electrostatic charge from the belt 73 can be restricted so that a toner image can be well transferred on a paper 51.

More preferably, the belt 73 is made of a material whose volume resistance is in the range of $10^{12}$-$10^{14}$ [Ω cm]. The remaining parts of the drive roller 71 and the follow roller 72 other than the surface layers thereof may be made of the same material as the surface layers or alternatively the remaining parts may be made of different materials.

The cleaning roller 75A and the backup roller 75B form a part of the cleaning device 75, and they are positioned downstream of the photosensitive drum 31*b* which is positioned downstream-most side as seen in the conveying direction DT of FIG. 1 and upstream of the follow roller 72 which supports the upstream end of the upper bridging portion 73*a*. In other words, the cleaning roller 75A and the backup roller 75B are arranged to sandwich the lower bridging portion 73*b*. A cleaning bias applying device 75C is provided to apply a minus voltage that is the opposite polarity of the toner T to the cleaning roller 75A. The backup roller 75B is earthed. When the cleaning bias applying device 75C applies a voltage to the cleaning roller 75A, the cleaning roller 75A charges negatively so as to capture plus-charged toner T adhered on the outer peripheral surface 73*c* of the belt 73.

A static charge removal member 77 is provided between the backup roller 75B and the follow roller 72 with a predetermined space defined between the belt 73 and the static charge removal member 77. The static charge removal member 77 discharges electrostatic charge from the belt 73 so that the belt 73 is free of electrostatic charge. The static charge removal member 77 is earthed. A self-discharge type static charge remover in the shape of a metallic needle or a metallic brush may be used as the static charge removal member 77.

Description will be given on parts of the belt 73 which are electrostatically charged during the driving of the belt 73.

The belt 73 is made of a material that is closer to the positive end in the triboelectric series than the drive roller 71 and the follow roller 72, so that when the belt 73 is driven to frictionally contact with the drive roller 71 made of urethane, the inner peripheral surface 73*d* of the belt 73 charges positively and the outer peripheral surface 73*c* of the belt 73 charges negatively.

These electrostatically charged parts are moved toward the cleaning roller 75A while retaining their charge distribution. Accordingly, in the region between the drive roller 71 and the cleaning roller 75A, plus-charged toner T is reliably held on the outer peripheral surface 73*c* of the belt 73 that has charged negatively.

The cleaning roller 75A is applied with a minus voltage. When the minus-charged outer peripheral surface 73*c* of the belt 73 reaches the cleaning roller 75A, the plus-charged toner T that is adhered on this minus-charged outer peripheral surface 73*c* is captured by the cleaning roller 75A and then stored into the toner storage tank 76 (see FIG. 1). When the belt 73 passes the cleaning roller 75A, the outer peripheral surface 73*c* thereof charges positively and the inner peripheral surface 73*d* thereof charges negatively.

When the minus-charged inner peripheral surface 73*d* of the belt 73 reaches the static charge removal member 77, the static charge removal member 77 removes the electrostatic charge so that the inner peripheral surface 73*d* of the belt 73 is free of electrostatic charge. If the static charge removal member 77 does not remove all the electrostatic charge from the belt 73, the belt 73 is moved toward the follow roller 72 with the outer peripheral surface 73*c* thereof continuously charged positively and with the inner peripheral surface 73*d* thereof continuously charged negatively.

When the belt 73 reaches the follow roller 72 while retaining the remaining electrostatic charge on the inner peripheral surface 73*d* and the outer peripheral surface 73*c*, regardless of the electrostatic charge of these parts, the inner peripheral surface 73*d* charges positively and the outer peripheral surface 73*c* charges negatively due to frictional contact with the follow roller 72. These electrostatically charged parts of the belt 73 are moved toward the photosensitive drum 31 while retaining the charge distribution. Therefore, the outer peripheral surface 73*c* of the belt 73 remains charged negatively in a reliably manner in the region between the follow roller 72 and the photosensitive drum 31, so that when the electrostatically charged parts of the belt 73 reach the photosensitive drum 31, the toner T on the photosensitive drum 31 is reliably drawn or transferred toward the belt 73 because of the minus-charged outer peripheral surface 73*c* of the belt 73.

According to the image forming apparatus as constructed above, the following advantages can be obtained.

The inner peripheral surface 73*d* of the belt 73 charges positively due to frictional contact with the follow roller 72, and so the outer peripheral surface 73*c* of the belt 73 reliably charges negatively before reaching the arrangement position (transfer position) of the photosensitive drum 31. Therefore, plus-charged toner T can be well transferred toward the belt 73, so that the image quality of the transferred images can be improved.

The belt 73 is formed such that the inner peripheral surface 73*d* thereof charges positively due to frictional contact with the follow roller 72. This is particularly advantageous for the structure according to this embodiment, in which the cleaning roller 75A to which a voltage is applied makes the outer peripheral surface 73*c* of the belt 73 charge in the same polarity as the toner T.

In particular, the static charge removal member 77 may not reliably discharge all the electrostatic charge from the insulative belt. Therefore, it is advantageous to form the belt 73 according to this embodiment such that the inner peripheral surface 73*d* thereof charges positively by the frictional contact with the follow roller 72.

The outer peripheral surface 73*c* of the belt 73 charges negatively by the frictional contact with the drive roller 71, and so toner T is reliably captured on the outer peripheral surface 73*c* of the belt 73 and conveyed to the cleaning roller 75A where the toner T is reliably received in the toner storage tank 76. This can prevent the toner T from contaminating the inside of the image forming apparatus.

The present invention is not limited to the above specific embodiment, and various changes and modifications may be made without departing from the scope of the attached claims.

Figure 4:
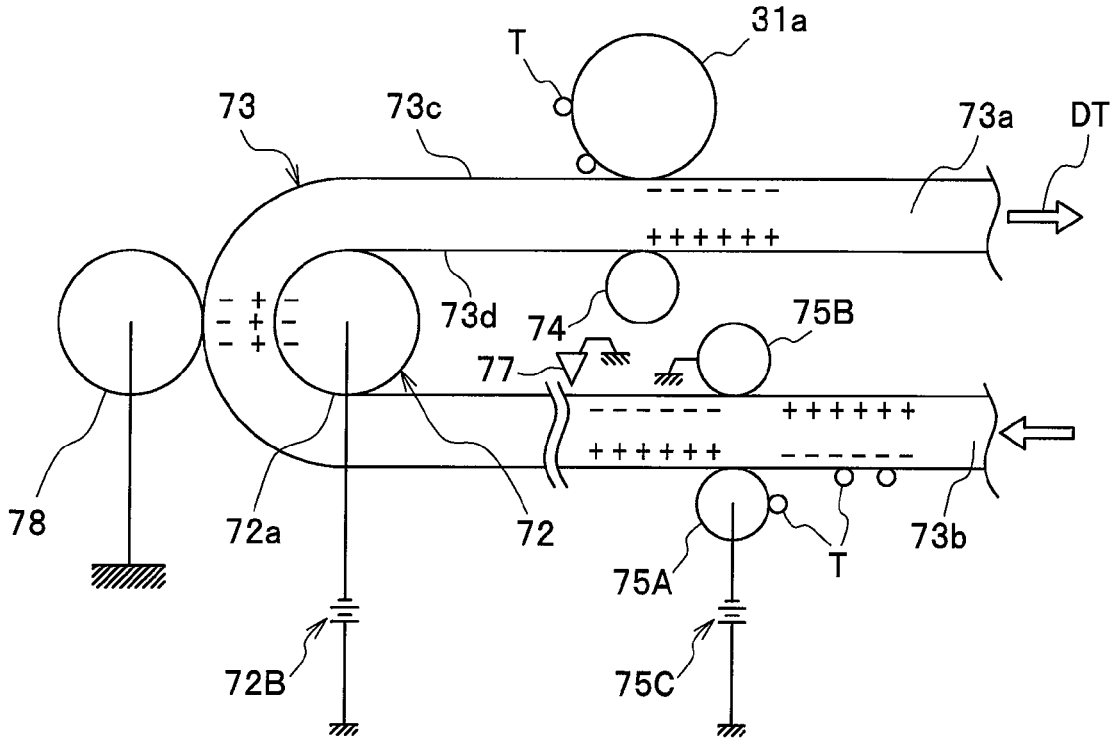
FIG. 4 is a view explaining the transfer unit according to another embodiment.

According to the above preferred embodiment, the inner peripheral surface 73*d* of the belt 73 is charged positively only by the frictional contacts with the drive roller 71 and the follow roller 72. However, an arrangement as shown in FIG. 4 may be employed so that the inner peripheral surface 73*d* of the belt 73 can be charged positively in a more reliable manner. To be more specific, as shown in the arrangement of FIG. 4 in which the structure around the drive roller 71 is omitted, an opposed roller 78 as an opposite member is provided in addition to the arrangement according to the above embodiment. The opposed roller 78 is earthed and positioned opposite of the follow roller 72 with the belt 73 interposed therebetween. Further, a bias applying device 72B is provided as a voltage applying device. The bias applying device 72B applies a minus voltage having the opposite polarity of the plus-charged toner T to the follow roller 72. This enables the inner peripheral surface 73*d* of the belt 73 to be charged in the same polarity as the toner T in a more reliable manner.

The number of rollers for supporting the belt 73 is two in the above embodiment. However, the number of rollers is not limited and three or more rollers may be employed.

Further, according to the above preferred embodiment, the belt 73 is made of a material which makes the inner peripheral surface 73*d* of the belt 73 charge in the same polarity as the toner T when the belt 73 respectively and frictionally contacts with all the rollers 71, 72 for supporting the belt 73. However, the present invention is not limited to this specific embodiment. The belt 73 may be made of any known material as long as the belt 73 charges in the same polarity as the toner T when it frictionally contacts with the outer peripheral surface of the upstream-side roller for supporting the upstream end of the bridging portion that is interposed between the photosensitive element and the transfer element.

However, it is more preferable that the belt 73 is made of a material which makes the inner peripheral surface 73*d* of the belt 73 charge in the same polarity as the toner T when it frictionally contacts with all the rollers, respectively, because the inner peripheral surface 73*d* of the belt 73 can be reliably charged in the same polarity as the toner T. Especially, if more than three rollers are provided, it is preferable that two or more rollers are arranged between the upstream-most photosensitive element and the cleaning device, and the belt 73 is made of a material which makes the inner peripheral surface 73*d* of the belt 73 charge in the same polarity as the toner T when the belt 73 frictionally contacts with the respective rollers arranged between the upstream-most photosensitive element and the cleaning device. This enables the inner peripheral surface 73*d* of the belt 73 to be reliably charged in the same polarity as the toner T before reaching the upstream-most photosensitive element and upon frictional contacts with the two or more rollers.

According to the above preferred embodiment, the belt 73 is entirely made of a material such as a nylon base material that is selected on the basis of relations with the rollers 71, 72. However, the material for the belt 73 is not limited to this material. As long as at least the inner surface layer (inner peripheral surface 73*d*) of the belt 73 is made of this material, other parts may be made of other known material.

In the embodiments such as shown in FIGS. 2 and 4, the backup member, the cleaning device, and the opposite member are rotatable rollers. However, these members may contact with the belt 73 in a non-rotatable manner.

According to the preferred embodiment, the drive roller 71 and the follow roller 72 are made of different materials. However, the present invention is not limited to this specific embodiment. For example, both of the rollers 71, 72 may be made of urethane. Since the follow roller 72 does not drive the belt 73 and may be made of a material having a lower friction coefficient, as described in the preferred embodiment, it is preferable that the follow roller 72 is made of aluminum for example as a low-cost material which is lower in cost than urethane.

Toner T charges positively in the preferred embodiment. However, the toner T may charge negatively. In this instance, the belt 73 is either made of a material that is closer to the negative end in the triboelectric series as with the minus-charged toner T than the drive roller 71 and the follow roller 72 or a material that is closer to the negative end in the triboelectric series as with the photosensitive drum 31 to be charged negatively by the charger 32 than the drive roller 71 and the follow roller 72. More specifically, the inner surface layer of the belt is made of rubber, and the surface layer of the upstream-side roller is made of aluminum.

Figure 5:
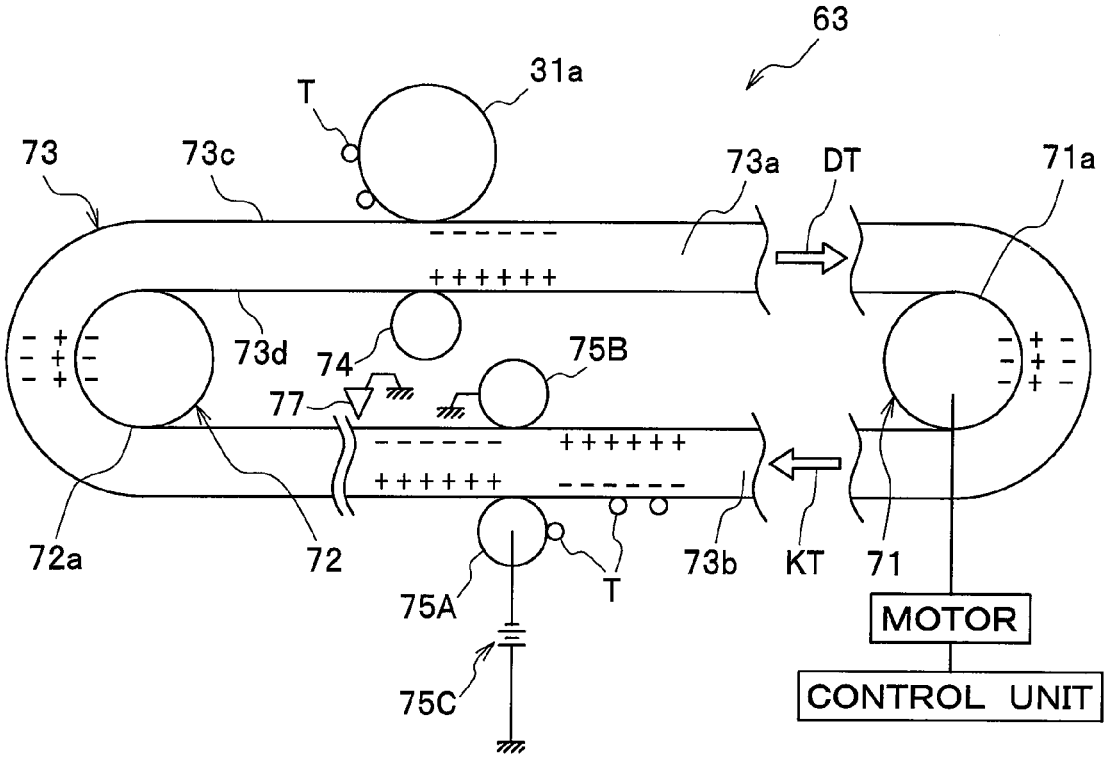
FIG. 5 is a view explaining the transfer unit according to a modified embodiment.

Further, in the above preferred embodiment, there may be provided a control unit which controls the operation of the motor for driving the belt 73 as well as the operations of the photosensitive drum 31 and the transfer roller 74. As shown in FIG. 5, the control unit controls the motor so that the belt 73 is moved for a predetermined distance before a paper 51 is fed on the belt 73. More specifically, the control unit is configured to operate the motor so that the belt 73 is moved for one complete turn or more at the start-up of the laser printer 1.

Accordingly, driving the belt 73 for one complete turn or more enables the entire length of the inner peripheral surface of the belt 73 to be charged in the same polarity as the toner T. This can improve the image quality of transferred images in a more reliable manner.

According to this configuration of the control unit, the inner peripheral surface 73*d* of the belt 73 is charged positively by the frictional contact with the follow roller 72 before a paper 51 is fed on the belt 73. Therefore, the outer peripheral surface 73*c* of the belt 73 is reliably charged negatively before reaching the photosensitive drum 31 (transfer position) so that the plus-charged toner T is well transferred toward the belt 73. This can further improve the image quality of transferred images.

Although the present invention has been described as being applied to a color laser printer, the present invention is applicable to other image forming apparatus such as a copying machine and a multifunction device.

In the above preferred embodiment, the photosensitive drum 31 is used as an example of the photosensitive element. However, an intermediate transfer belt or a photosensitive belt may be used for carrying toner.

In the above preferred embodiment, the transfer roller 74 is used as an example of the transfer element. However, the transfer element may be of a non-contacting type.

What is claimed is:

1. An image forming apparatus comprising:

a plurality of rollers;

an endless belt looped around the plurality of rollers so that a bridging portion is formed between rollers and both ends of the bridging portion are supported on the rollers, the endless belt being insulative and driven in a predetermined driving direction so as to convey a record sheet;

a photosensitive element positioned outside of and facing an outer peripheral surface of the bridging portion of the endless belt, the photosensitive element forming developer images when electrostatically charged developer is deposited thereon; and a transfer element positioned opposite of the photosensitive element with the bridging portion interposed therebetween, and to which a transfer bias is applied so as to transfer the developer from the photosensitive element to the record sheet, wherein the plurality of rollers includes an upstream-side roller for supporting an upstream end of the bridging portion that is interposed between the photosensitive element and the transfer element as seen in the driving direction of the endless belt; and wherein an inner peripheral surface of the endless belt is made of a material which has greater tendency to be charged in a polarity that is the same as the developer in triboelectric series than an outer peripheral surface of the upstream-side roller.

2. An image forming apparatus according to claim 1, wherein the inner peripheral surface of the endless belt is made of a material to be charged in a polarity that is the same as the developer in the triboelectric series with respect to the outer peripheral surface of each of the plurality of rollers.

3. An image forming apparatus according to claim 1, further comprising an opposite member earthed and positioned opposite of the upstream-side roller with the endless belt interposed therebetween, and a voltage applying device for applying a voltage having an opposite polarity of the developer to the upstream-side roller.

4. An image forming apparatus according to claim 1, further comprising a cleaning device, to which a voltage having an opposite polarity of the developer is applied for capturing developer on the endless belt, wherein the cleaning device is positioned outside of and facing the outer peripheral surface of the endless belt at a position downstream of a transfer position where the endless belt lies interposed between the photosensitive element and the transfer element and at a position upstream of the upstream-side roller as seen in the driving direction of the endless belt, and wherein a backup member is earthed and provided at a position opposite of the cleaning device with the endless belt interposed therebetween.

5. An image forming apparatus according to claim 1, wherein of the plurality of rollers except for the upstream-side roller, one or more rollers or all of the remaining rollers have an outer peripheral surface made of a material whose friction coefficient is higher than that of the upstream-side roller.

6. An image forming apparatus according to claim 1, wherein the photosensitive element forms developer images by depositing thereon plus-charged developer, and wherein the endless belt is made of a material mainly containing nylon.

7. An image forming apparatus according to claim 6, wherein the plurality of rollers includes a drive roller and a follow roller, and the upstream-side roller is the follow roller, and wherein the outer peripheral surface of the drive roller is made of urethane, and the outer peripheral surface of the follow roller is made of aluminum.

8. An image forming apparatus according to claim 1, wherein plural sets of the photosensitive element and the transfer element are provided for color image formation along the bridging portion at positions corresponding to respective colors, and wherein the upstream-side roller is a roller for supporting an upstream end of the bridging portion that is interposed between the set of photosensitive element and the transfer element which is positioned on the upstream-most side as seen in the driving direction of the endless belt.

9. An image forming apparatus comprising:

a plurality of rollers;

an endless belt looped around the plurality of rollers so that a bridging portion is formed between rollers and both ends of the bridging portion are supported on the rollers, the endless belt being insulative and driven in a predetermined driving direction so as to convey a record sheet;

a photosensitive element positioned outside of and facing an outer peripheral surface of the bridging portion of the endless belt;

a charger for charging a surface of the photosensitive element;

an exposure device for exposing the surface of the photosensitive element to be charged by the charger; and a transfer element positioned opposite of the photosensitive element with the bridging portion interposed therebetween, and to which a transfer bias is applied so as to transfer developer that is deposited on the exposed surface of the photosensitive element from the photosensitive element to the record sheet, wherein the plurality of rollers includes an upstream-side roller for supporting an upstream end of the bridging portion that is interposed between the photosensitive element and the transfer element as seen in the driving direction of the endless belt; and wherein an inner peripheral surface of the endless belt is made of a material which has greater tendency to be charged in a polarity that is the same as the photosensitive element to be charged by the charger in triboelectric series than an outer peripheral surface of the upstream-side roller.

10. An image forming apparatus according to claim 9, wherein the photosensitive element is charged to a plus polarity by the charger, and wherein the endless belt is made of a material mainly containing nylon.

11. An image forming apparatus according to claim 10, wherein the plurality of rollers includes a drive roller and a follow roller, and the upstream-side roller is the follow roller, and wherein the outer peripheral surface of the drive roller is made of urethane, and the outer peripheral surface of the follow roller is made of aluminum.

12. An image forming apparatus according to claim 9, wherein plural sets of the photosensitive element, the charger, and the transfer element are provided for color image formation along the bridging portion at positions corresponding to respective colors, and wherein the upstream-side roller is a roller for supporting an upstream end of the bridging portion that is interposed between the set of photosensitive element and the transfer element which is positioned on the upstream-most side as seen in the driving direction of the endless belt.

13. An image forming apparatus comprising:

a plurality of rollers;

an endless belt looped around the plurality of rollers so that a bridging portion is formed between rollers and both ends of the bridging portion are supported on the rollers, the endless belt being insulative and driven in a predetermined driving direction so as to convey a record sheet;

a photosensitive element positioned outside of and facing the outer peripheral surface of the bridging portion of the endless belt, the photosensitive element forming developer images when electrostatically charged developer is deposited thereon;

a transfer element positioned opposite of the photosensitive element with the bridging portion interposed therebetween, and to which a transfer bias is applied so as to transfer the developer from the photosensitive element to the record sheet; and a control unit for controlling operations of the photosensitive element and the transfer element as well as for controlling a drive of the endless belt, wherein the plurality of rollers includes an upstream-side roller for supporting an upstream end of the bridging portion that is interposed between the photosensitive element and the transfer element as seen in the driving direction of the endless belt;

wherein an inner peripheral surface of the endless belt is made of a material which has greater tendency to be charged in a polarity that is the same as the developer in triboelectric series than an outer peripheral surface of the upstream-side roller; and wherein the control unit drives the endless belt for a predetermined distance in the driving direction before the record sheet is fed on the endless belt.

14. An image forming apparatus according to claim 13, wherein plural sets of the photosensitive element and the transfer element are provided for color image formation along the bridging portion at positions corresponding to respective colors, and wherein the upstream-side roller is a roller for supporting an upstream end of the bridging portion that is interposed between the set of photosensitive element and the transfer element which is positioned on the upstream-most side as seen in the driving direction of the endless belt.

15. An image forming apparatus comprising:

a plurality of rollers;

an endless belt looped around the plurality of rollers so that a bridging portion is formed between rollers and both ends of the bridging portion are supported on the rollers, the endless belt being insulative and driven in a predetermined driving direction so as to convey a record sheet;

a photosensitive element positioned outside of and facing the outer peripheral surface of the bridging portion of the endless belt;

a charger for charging a surface of the photosensitive element;

an exposure device for exposing the surface of the photosensitive element to be charged by the charger;

a transfer element positioned opposite of the photosensitive element with the bridging portion interposed therebetween, and to which a transfer bias is applied so as to transfer developer that is deposited on the exposed surface of the photosensitive element from the photosensitive element to a record sheet; and a control unit for controlling operations of the photosensitive element, the charger, the exposure device, and the transfer element as well as for controlling a drive of the endless belt, wherein the plurality of rollers includes an upstream-side roller for supporting an upstream end of the bridging portion that is interposed between the photosensitive element and the transfer element as seen in the driving direction of the endless belt;

wherein an inner peripheral surface of the endless belt is made of a material which has greater tendency to be charged in a polarity that is the same as the photosensitive element to be charged by the charger in triboelectric series than an outer peripheral surface of the upstream-side roller; and wherein the control unit drives the endless belt for a predetermined distance in the driving direction before the record sheet is fed on the endless belt.

16. An image forming apparatus according to claim 15, wherein plural sets of the photosensitive element, the charger, and the transfer element are provided for color image formation along the bridging portion at positions corresponding to respective colors, and wherein the upstream-side roller is a roller for supporting an upstream end of the bridging portion that is interposed between the set of photosensitive element and the transfer element which is positioned on the upstream-most side as seen in the driving direction of the endless belt.

* * * * *